US008206188B1

(12) United States Patent
Zhang et al.

(10) Patent No.: US 8,206,188 B1
(45) Date of Patent: Jun. 26, 2012

(54) CONNECTOR TERMINAL

(75) Inventors: Hong-Tu Zhang, Guang-Dong (CN); Ping-Chih Chen, Tu-Cheng (TW); Ming-Chiang Chen, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 3 days.

(21) Appl. No.: 12/980,228

(22) Filed: Dec. 28, 2010

(51) Int. Cl.
*H01R 4/48* (2006.01)

(52) U.S. Cl. ..... 439/862

(58) Field of Classification Search ..... 439/862, 439/816, 835, 834, 83, 500; 24/305
See application file for complete search history.

(56) References Cited

U.S. PATENT DOCUMENTS 6,695,628 B2 * 2/2004 Yeh ..... 439/83
7,510,448 B2 * 3/2009 Eppe et al. ..... 439/835
7,674,140 B2 * 3/2010 Eppe et al. ..... 439/816
7,927,158 B2 * 4/2011 Kim et al. ..... 439/816
8,070,498 B2 * 12/2011 Shen ..... 439/66
2006/0276085 A1 * 12/2006 Ma et al. ..... 439/862
2008/0083097 A1 * 4/2008 Lang et al. ..... 24/305

* cited by examiner

*Primary Examiner* — Alexander Gilman
(74) *Attorney, Agent, or Firm* — Cheng-Ju Chiang

(57) ABSTRACT

A connector terminal curved from a strip-shaped metal plate has a soldering plate of which a substantial middle of one end edge extends upward to form a bracket plate, an arched connecting portion bent upward from the other end of the soldering plate and apart facing the bracket plate, and a flexible arm extending from a free end of the connecting portion towards the bracket plate and parallel to the soldering plate. Two opposite side edges of a top end of the bracket plate oppositely protrude to form a pair of blocking ears. A free end of the flexible arm is arched upward to form an inverted-V shaped contacting portion adjacent to the bracket plate. Two ends of a distal edge of the contacting portion further extend beyond the two opposite side edges of the bracket plate to form a pair of resisting tails respectively restrained under the blocking ears.

4 Claims, 2 Drawing Sheets

CONNECTOR TERMINAL

BACKGROUND OF THE INVENTION

1. Field of the Invention

The present invention relates to a connector terminal, and particularly to a connector terminal curved from a strip-shaped metal plate.

2. The Related Art

Referring to FIG. 1, a conventional connector terminal 100' is of substantially lying-U shape and has a soldering plate 10'. One end of the soldering plate 10' is bent upwards to form a connecting portion 20'. A free end of the connecting portion 20' further extends towards a direction parallel to the soldering plate 10' to form a flexible arm 30' apart facing the soldering plate 10'. A free end of the flexible arm 30' is arched opposite to the soldering plate 10' to form a contacting portion 40'.

However, when excessive press force acts on the contacting portion 40' repeatedly, the contacting portion 40' is apt to randomly slant during the up-and-down movement thereof that results in an unsteady connection between the connector terminal 100' and a mating module (not shown). Moreover, the contacting portion 40' may be often excessively pressed downward by the mating module to result in a deformation of the connector terminal 100' due to not having any blocking structures.

SUMMARY OF THE INVENTION

An object of the present invention is to provide a connector terminal curved from a strip-shaped metal plate. The connector terminal has a soldering plate of which a substantial middle of one end edge extends upward to form a bracket plate perpendicular to the soldering plate, an arched connecting portion bent upward from the other end of the soldering plate and apart facing the bracket plate, and a flexible arm extending from a free end of the connecting portion towards the bracket plate and parallel to the soldering plate. Two opposite side edges of a top end of the bracket plate oppositely protrude to form a pair of blocking ears. A free end of the flexible arm is arched oppositely to the soldering plate to form an inverted-V shaped contacting portion adjacent to the bracket plate. Two ends of a distal edge of the contacting portion further extend beyond the two opposite side edges of the bracket plate to form a pair of resisting tails respectively restrained under the blocking ears. The contacting portion can elastically move up and down along the bracket plate and further is avoided an excessive pressure downward by means of the block of the blocking ears.

As described above, during the connector terminal working, the bracket plate can effectively guide the contacting portion to move up and down. Furthermore, the blocking ears preloaded on the corresponding resisting tails can block excessive press force being acted on the contacting portion so that can avoid the deformation of the connector terminal.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
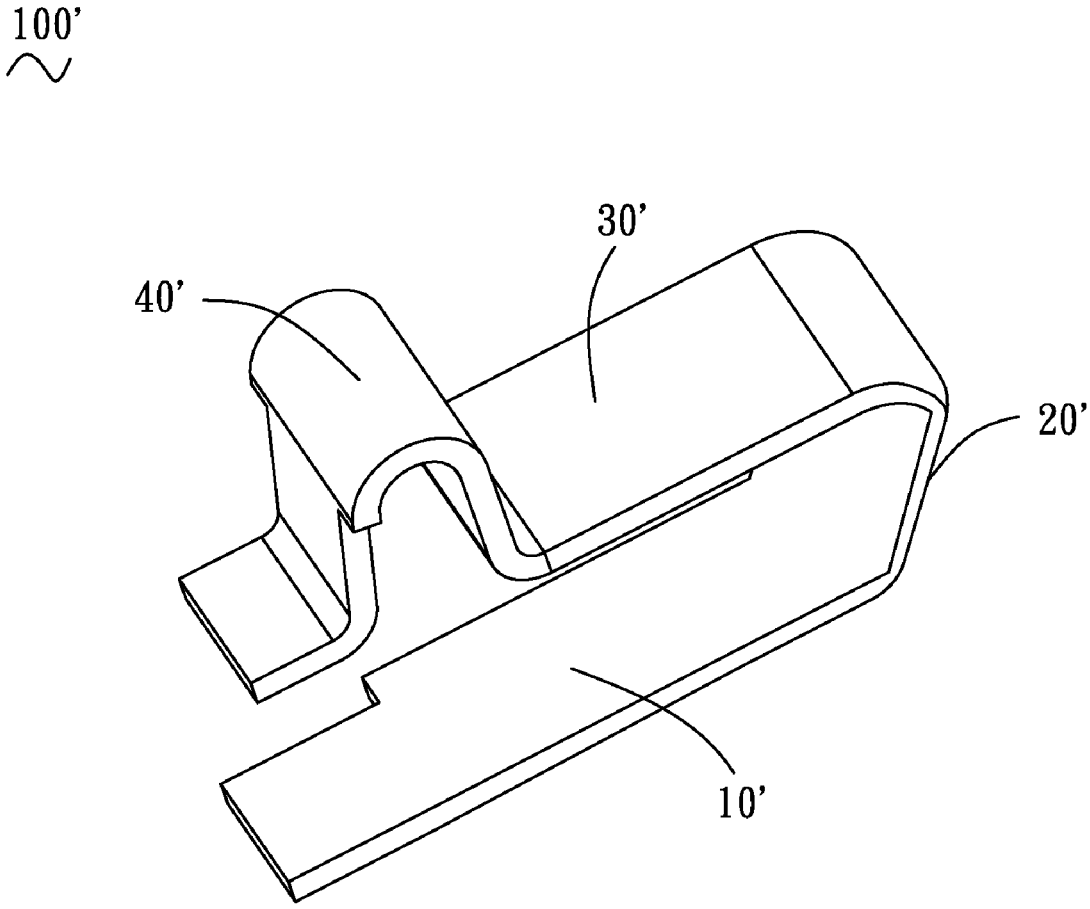
FIG. 1 (Prior Art)
FIG. 1 is a perspective view of a connector terminal in accordance with the prior art.
Figure 2:
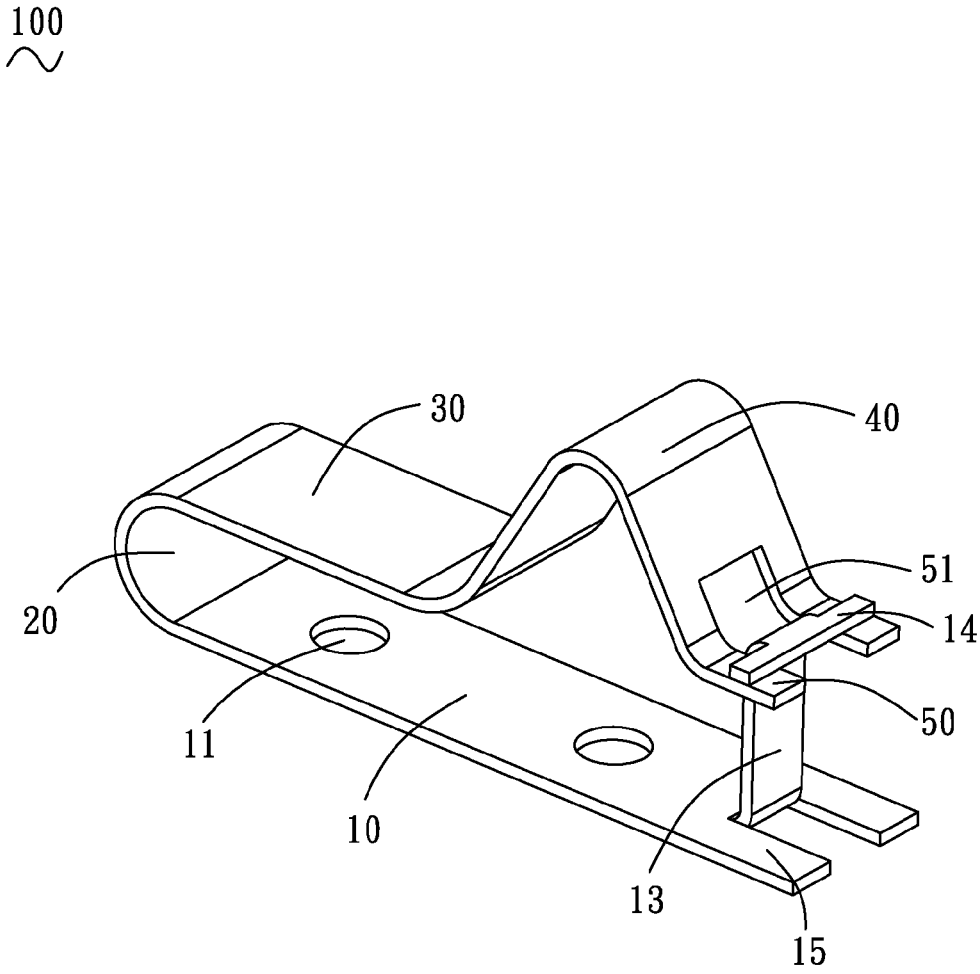
FIG. 2 is a perspective view of a connector terminal of an embodiment in accordance with the present invention.

Referring to the drawings in greater detail, and first to FIG. 2, the embodiment of the invention is embodied in a connector terminal 100. The connector terminal 100 is curved from a strip-shaped metal plate. The connector terminal 100 has a strip-shaped soldering plate 10, a flexible arm 30 and an arched connecting portion 20 which connects the soldering plate 10 and the flexible arm 30 to make the connector terminal 100 substantially show a lying U-shape from a lateral view. A free end of the flexible arm 30 is arched oppositely to the soldering plate 10 to form an inverted-V shaped contacting portion 40. Two ends of a distal edge of the contacting portion 40 further extend oppositely to the flexible arm 30 and parallel to the soldering plate 10 to form a pair of resisting tails 50 apart from each other to define an open passage 51 therebetween. The open passage 51 is further spread obliquely and upward to the distal end of the contacting portion 40.

At least one hole 11 is opened in the soldering plate 10 for accumulating excessive melting solder therein to avoid the excessive melting solder spreading to the connecting portion 20, when the soldering plate 10 is soldered on a printed circuit board (not shown). A middle portion of a distal edge of the soldering plate 10 extends towards the open passage 51 to form a bracket plate 13 substantially perpendicular to the soldering plate 10. Two opposite side edges of a free end of the bracket plate 13 protrude oppositely to form a pair of blocking ears 14, wherein the free end of the bracket plate 13 passes through the open passage 51 to make the blocking ears 14 respectively preloaded on the corresponding resisting tails 50. Furthermore, the blocking ears 14 can block an external force excessively pressing the contacting portion 40 downward to result in a deformation of the connector terminal 100. Two ends of the distal edge of the soldering plate 10 further extend oppositely to the soldering plate 10 to form a pair of blocking tails 15 located at two opposite sides of the bracket plate 13. The blocking tails 15 face the resisting tails 50 respectively for providing a positive force to support the contacting portion 40 and further avoiding the deformation of the connector terminal 100, when the contacting portion 40 is pressed downward by the external force to cause the resisting tails 50 to be against the blocking tails 15. The contacting portion 40 elastically moves up and down along the bracket plate 13 under the guidance of the open passage 51, wherein the bracket plate 13 has a width matching with that of the open passage 51 to prevent the contacting portion 40 slanting randomly.

As described above, during the connector terminal 100 working, the cooperation between the open passage 51 and the bracket plate 13 can effectively avoid the contacting portion 40 randomly slanting when the contacting portion 40 moves up and down. Furthermore, the blocking ears 14 preloaded on the corresponding resisting tails 50 can block excessive press force being acted on the contacting portion 40, and the cooperation between the blocking tails 15 and the corresponding resisting tails 50 provides the positive force to support the contacting portion 40, so that further effectively avoid the deformation of the connector terminal 100.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector terminal curved from a strip-shaped metal plate, comprising:

a soldering plate of which a substantial middle of one end edge extends upward to form a bracket plate perpendicular to the soldering plate, two opposite side edges of a top end of the bracket plate oppositely protruding to form a pair of blocking ears;

an arched connecting portion bent upward from the other end of the soldering plate and apart facing the bracket plate; and a flexible arm extending from a free end of the connecting portion towards the bracket plate and parallel to the soldering plate, a free end of the flexible arm being arched oppositely to the soldering plate to form an inverted-V shaped contacting portion adjacent to the bracket plate, two ends of a distal edge of the contacting portion further extending beyond the two opposite side edges of the bracket plate to form a pair of resisting tails respectively restrained under the blocking ears, the contacting portion capable of elastically moving up and down along the bracket plate and further being avoided an excessive pressure downward by means of the block of the blocking ears.

2. The connector terminal as claimed in claim 1, wherein the distance between the two resisting tails matches with the width of the bracket plate to prevent the contacting portion slanting randomly when the contacting portion moves up and down.

3. The connector terminal as claimed in claim 1, wherein two ends of the one end edge of the soldering plate further extends oppositely to the soldering plate to form a pair of blocking tails which face the resisting tails respectively for providing a positive force to support the contacting portion, when the contacting portion is pressed downward to cause the resisting tails to be against the blocking tails.

4. The connector terminal as claimed in claim 1, wherein at least one hole is opened in the soldering plate for accumulating excessive melting solder therein, when the soldering plate is soldered on an external printed circuit board.

* * * * *